US006035776A

United States Patent [19]

Segura

[11] Patent Number: 6,035,776

[45] Date of Patent: Mar. 14, 2000

[54] REFUSE AND GRINDING SYSTEM

[76] Inventor: Victor J. Segura, 4112 Old Jeanerette Rd., New Iberia, La. 70560

[21] Appl. No.: 09/046,063

[22] Filed: Mar. 23, 1998

[51] Int. Cl.[7] ..... B30B 15/08

[52] U.S. Cl. ..... 100/97; 100/193; 100/229 A; 100/269.06; 100/269.14

[58] Field of Search ..... 100/94, 97, 102, 100/193, 221, 229 A, 269.06, 269.14, 269.15; 241/101.01, 101.2

[56] References Cited

U.S. PATENT DOCUMENTS

| | | | |
|---|---|---|---|
| 3,413,913 | 12/1968 | Smedlund . | |
| 3,438,321 | 4/1969 | Gladwin . | |
| 3,589,276 | 6/1971 | Swallert | 100/97 |
| 3,589,277 | 6/1971 | Gray et al. . | |
| 3,680,475 | 8/1972 | Gladwin . | |
| 3,695,175 | 10/1972 | Bausenbach et al. | 100/193 |
| 3,726,211 | 4/1973 | Gladwin . | |
| 3,734,006 | 5/1973 | Hennells . | |
| 3,805,690 | 4/1974 | Goldkuhle | 100/269.06 |
| 3,861,117 | 1/1975 | DeFilippi | 100/97 |
| 3,863,561 | 2/1975 | Karls . | |
| 4,098,181 | 7/1978 | Schultz | 100/102 |
| 4,102,263 | 7/1978 | Forsberg | 100/102 |
| 4,996,918 | 3/1991 | Carter et al. . | |
| 5,129,318 | 7/1992 | Zimmer | 100/193 |
| 5,172,630 | 12/1992 | Thompson | 100/193 |
| 5,279,215 | 1/1994 | Harder | 100/269.06 |

*Primary Examiner*—Stephen F. Gerrity
*Attorney, Agent, or Firm*—Domingue & Waddell, PLC

[57] ABSTRACT

A refuse and grinding system. The system will contain a hydraulic fluid supply for supplying a hydraulic fluid and a first compactor adapted for containing a refuse. The first compactor will have a first ram assembly and a first hydraulic valve, with the ram assembly having a first cell and a second cell. The first hydraulic valve is operatively connected with the hydraulic fluid supply, as well as the first and second cell. The system will contain a second compactor adapted for containing a hydrocarbon refuse such as oil filters. The second compactor contains a second ram assembly and a second hydraulic valve, with the second ram assembly having a first cell and a second cell. The second compactor will include a second hydraulic valve that is operatively connected, and in series arrangement with, the first hydraulic valve. The compactor will also comprise a grinder having a blade member contained therein. The blade member is responsive to the hydraulic supply that is fed to a hydraulic motor. The novel system will further comprise a pump, operatively associated with the first hydraulic valve, for pumping the hydraulic supply to the first hydraulic valve, and, an air supply member adapted for providing a pneumatic air supply to the pump.

18 Claims, 5 Drawing Sheets

REFUSE AND GRINDING SYSTEM

BACKGROUND OF THE INVENTION

This invention relates to a novel compactor. More particularly, but not by way of limitation, this invention relates to a compactor that may be used to dispose of all types of refuge from a vessel or offshore platform.

Trash compactors provide a necessary function in that they disposal of trash in an economical and efficient manner. As society continues to progress, the proper environmental disposal of refuse is of prime importance to governments. Therefore, government regulations have been promulgated that mandate restrictions on the proper disposal of refuse.

As the search for oil and gas continues, exploration companies have ventured into oceans such as the North Sea and the Gulf of Mexico. The exploration, drilling and production of minerals necessarily entails the involvement of thousand of people who essentially live on drilling and production platforms. The offshore industry personnel will produce tons of waste during these operations. This waste will have to be disposed of in an economically and environmentally responsible fashion.

Certain types of garbage must be compressed and bagged for transportation to a shore base for proper handling. Garbage such as cardboard, paper, plastic, etc. must be bagged and sent back to shore. Environmentally sensitive waste such as oil filters must be specially bagged and sent back to shore. On the other hand, garbage such as food waste may properly be disposed of by discarding over board. However, governmental regulations mandate that the average particle dimension be a certain size. Thus, it is not feasible to simply discard the garbage over board. Instead, the garbage must be ground.

The drilling and production platforms working in the sea, as well as marine vessels, are of finite room. On these of types of platforms, a premium is placed on minimizing space requirements. Thus, necessary equipment such as trash compactors must be included. Nevertheless, minimizing the space needed for the trash compactor is critical. Also, the platforms will produce their own power systems. Therefore, while electricity is available, the usage of electricity is limited due to power generation limitations. Further, electricity is explosive, and hence, electrical use is restricted on these vessels and platforms for safety reasons.

Prior art refuse compactors are available. However, the prior art compactors are bulky and do not take into consideration limited size restraints. Further, the prior art compactors require electrical current or other types of power supply that are only available in industrial and household settings. The prior art systems also do not combine a garbage disposal, environmentally sensitive trash (such as oil filters) and food grinders into a single unit. Therefore, there is a need for a compactor that will solve these and other problems in the prior art as it relates to marine and remote industrial settings.

SUMMARY OF THE INVENTION

A refuse compacting and grinding system is disclosed. The system will contain a hydraulic fluid supply for supplying a hydraulic fluid and a first compactor adapted for containing a refuse. The first compactor will have a first ram assembly and a first hydraulic valve member, with the first ram assembly having a first cell cylinder and a second cell cylinder. The first hydraulic valve member is operatively connected with the hydraulic fluid supply, as well as the first and second cell.

The compactor will contain a second system adapted for containing a hydrocarbon refuse such as oil filters. The second compactor contains a second ram assembly and a second hydraulic valve member, with the second ram assembly having a first cell cylinder and a second cell cylinder. The second compactor will include a second hydraulic valve member that is operatively connected, and in series arrangement with, the first hydraulic valve member. The compactor will also comprise a grinder member having a blade member contained therein. The grinder member is responsive to the hydraulic supply that is fed to a hydraulic motor. The grinder member will contain a hydraulic supply inlet being in fluid series communication with the first hydraulic valve member.

The novel system will further comprise an energizing means for energizing the first compactor, the second compactor and the grinder member with the hydraulic fluid. In the preferred embodiment, the energizing means comprises a pump means, operatively associated with the first hydraulic valve member, for pumping the hydraulic supply to the first hydraulic valve member; and, an air supply member adapted for providing a pneumatic air supply to the pump means.

In one embodiment, the first ram assembly contains a first cylindrical member with a first piston disposed therein forming a first cell and a second cell, with the first cell containing a first channel fluidly connecting the first cell with the first hydraulic valve member and a second channel fluidly connecting the second cell with the first hydraulic valve member. The second ram assembly may also contain a second cylindrical member with a second piston disposed therein so that a third cell and a fourth cell are formed, with the third cell containing a third channel fluidly connecting the third cell with the second hydraulic valve member and the fourth channel fluidly connecting the fourth cell with the second hydraulic valve member.

Also, the hydraulic supply inlet of the grinder member may contain a third hydraulic valve member, with the third hydraulic valve member being operatively connected to the hydraulic motor. The third hydraulic valve member has a first position directed to rotate the grinder in a clockwise mode and a second position directed to rotate the blade member in a counterclockwise mode.

The compactor may further comprise an air lubricator means, operatively associated with the air supply member, for lubricating the air supply to the pump means, as well as an air filter means, operatively associated with the air supply member, for filtering the air supply being directed into the pump means. Further, the pump means may include an air over hydraulics motor adapted to receive the air supply and provide a torque to a shaft. The hydraulic pump member is in turn operatively connected to the air over hydraulic motor and adapted to receive the torque from the shaft for driving the hydraulic pump member.

In yet another embodiment, the first cell of the first compactor has associated therewith a first receptacle for receiving a refuse, and the receptacle is movably mounted within the first compactor. In still yet another embodiment, the third cell of the second compactor has associated therewith a second receptacle for receiving a hydrocarbon contaminated refuse such as an oil filter.

In the preferred embodiment, the grinder means comprises a cutter container having an inner portion and an outer portion along with a cutter head plate contained within the inner portion of the cutter container along with a cutter ring having an opening therein so that the cutter head plate is disposed therein. The grinder will also contain a hydraulic motor having a shaft extending therefrom, with the shaft being connected to the cutter head plate, and an adapter plate mounted on the hydraulic motor, with the adapter plate containing an aperture that has the shaft being disposed therethrough.

An advantage of the present invention includes the compact size for the multiple components that make up the unit. Another advantage includes the ability to connect one, or two, or all three components in series together. Another advantage is that the assembled unit may include garbage compactor/disposal, an oil filter compactor/disposal, and a food compactor/disposal.

Yet another advantage is that only one power system is needed to power the three components. Another advantage is that the power system is hydraulic driven by an exterior power source such as a pneumatic, electric, natural gas, diesel, etc. Still yet another advantage includes that the invention may be used in remote locations including marine and/or offshore exploration, drilling and production environments.

A feature of the present invention includes use of hydraulic valves in a series arrangement. Another feature includes having an individual receptacle for garbage refuse. Another feature of the invention consists of individual receptacles for oil filter waste and other waste containing environmentally sensitive compounds. Still yet another feature includes the ability to convert from a first power source such as pneumatic power into hydraulic power. Another feature is the use of the hydraulic motor that is energized via the hydraulic supply to rotate the grinder member in both a clockwise and counter-clockwise direction.

DETAILED DESCRIPTION OF THE PREFERRED EMBODIMENTS

Figure 1:
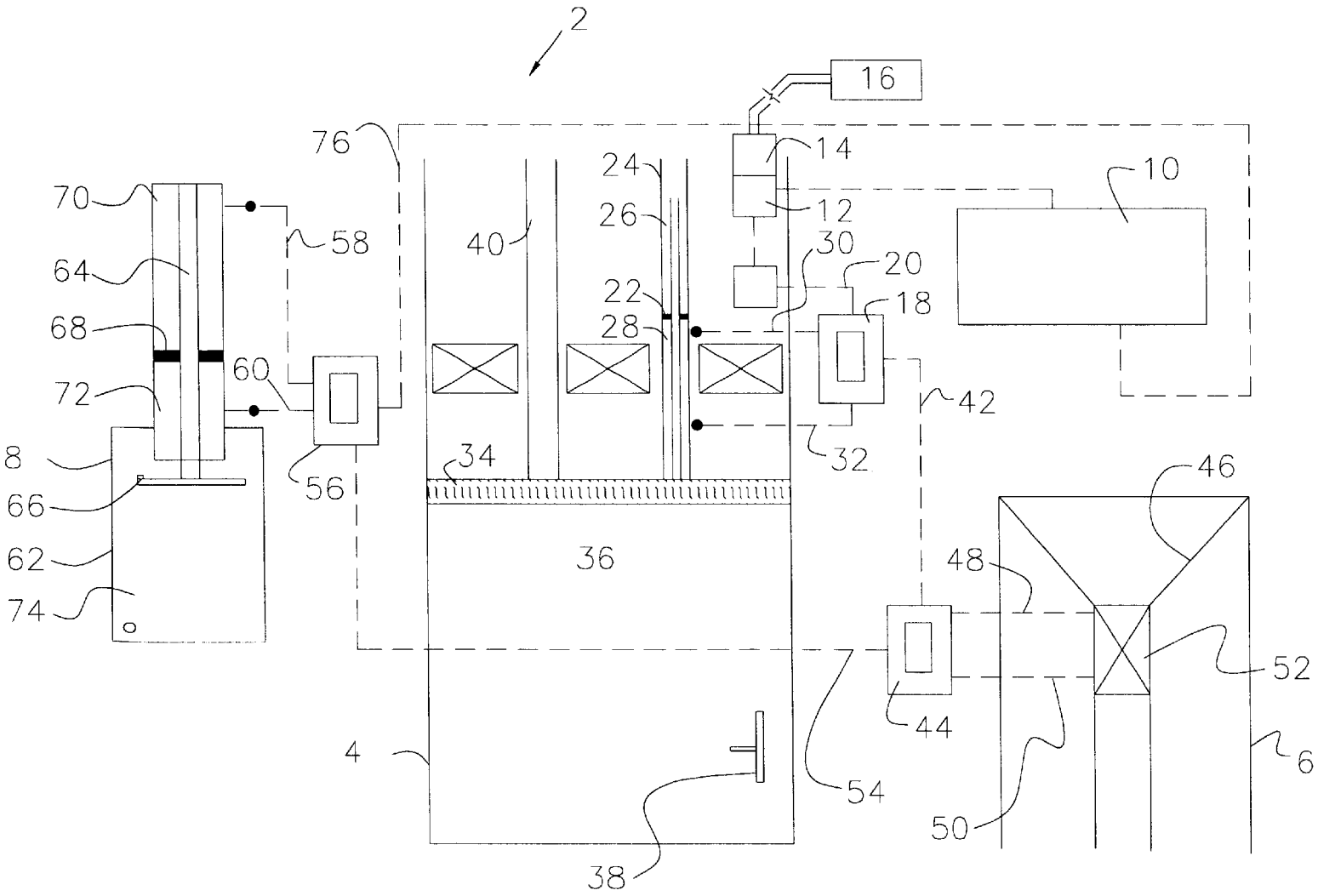
FIG. 1 is a schematic illustration of the novel combination compactor.

Referring now to FIG. 1, a schematic illustration of the novel trash compactor system 2 will now be described. In the preferred embodiment, the compactor system 2 contains a first compactor 4 that will be generally a trash compactor 4 capable of compressing trash. The compactor system 2 will also have associated therewith the grinder member 6 that may be used to grind a food substance and thereafter dispose of the contents. The system 2 further contains a second compactor 8 which may be an oil filter compactor capable of crushing and disposing of refuse containing environmentally hazardous substances such as oil filters.

In the preferred embodiment, the trash compactor system 2 will be powered via a hydraulic series arrangement. Thus, the trash compactor system 2 will contain a hydraulic fluid supply, with the hydraulic fluid supply being contained within the hydraulic tank 10. The system 2 also includes an energizing means for energizing the first compactor 4, the second compactor 8 and the grinder member 6 with the hydraulic fluid. In the preferred embodiment, the energizing means comprises a pump means 12 for pumping the hydraulic supply, and an air motor 14 adapted to pump means 12 for providing a pneumatic air supply to the pump means 12 as will be more fully set out in the application.

The air motor 14 will receive an air supply from an air source 16 such as a compressor. Many times, marine vessels and offshore rigs contain air compressors. The compressed air can then be used for different purposes. As pointed out earlier, lack of electrical generation capacity on these remote structures calls for minimizing the use of electricity. Also, due to the inherent safety issues, electrical use is restricted. Therefore, many systems utilize pneumatic energy in order to power devices. Therefore, the system herein disclosed utilizes the pressurized air from the vessel and/or rig in order to drive the air over hydraulic motor 14 which in turn will energize the pump means 12. The air motor 14 is commercially available. The pump means 12 is commercially available from Superior Hydraulics under the term P15 Commercial Shearing.

In the embodiment depicted in FIG. 1, the first compactor 4 contains a first hydraulic valve member 18. The first hydraulic valve member 18 is a multi passage flow-through valve which is commercially available from Brand Manufacturing Company under the mark Brand Valve. Thus, the line 20 runs from the outlet of pump means 12 to the inlet of the valve member 18. The first compactor 4 contains a ram piston 22 that is disposed within a cylinder 24 so that a first cell 26 and a second cell 28 are formed in relation to the piston 22.

The first hydraulic valve member 18 will contain a first bypass line 30 that leads from the valve member 18 to the first cell 26. The first hydraulic valve member 18 will also contain a second bypass line 32 that leads from the valve member 18 to the second cell 28. Thus, the piston 22 can be moved up or down relative to the cylinder 24 by directing the hydraulic pressurized fluid into either the cell 26 or cell 28. If the pressurized fluid is delivered to the cell 26, the piston 22 will be forced downward. If the pressurized fluid is delivered to the cell 28, the piston 22 will be forced downward.

The piston 22 will be connected at one end to the ram plate 34. The ram plate 34 fits into and is operatively associated with the receptacle 36. The receptacle is generally cubical so that a box is formed for containment of the trash. The ram plate 34 is situated so that as the ram plate 34 is lowered into the receptacle 36, the trash is compacted. Thus, a trash and/or garbage may be placed within the receptacle 36. Thereafter, the operator may manually direct the hydraulic fluid pressure via valve member 18 into the first cell 26 so that the piston 22 is forced downward into the receptacle 36. The valve member 18 will contain a handle for manually directing the hydraulic fluid from the neutral position, to the first bypass, or to the second bypass. As the ram plate 34 is forced downward, the trash/garbage is compacted. After proper compaction, the operator may then reverse the valve 18 so that the hydraulic fluid is now directed to the second cell 28 so that the piston 22 is lifted upward relative to receptacle 36. After the piston 22 has been lifted, the operator would place hydraulic valve member 18 (via the lever) into the neutral position.

The receptacle 34 will have a door 38 which may be opened. The receptacle 36 may be slidably mounted within so that the receptacle may be movably withdrawn once the receptacle is full. The preferred embodiment of FIG. 1 also depicts a guide member 40 that aids in guiding the ram plate 34 and piston 22 in its upward or downward movement. The guide member 40 also contributes to the stability of ram plate 34. The hydraulic valve member 18 will have an output line 42 that leads from the hydraulic valve member 18 to the hydraulic valve member 44. The hydraulic valve member 44 is similar in construction to the hydraulic valve member 18 previously described.

The preferred embodiment of FIG. 1 also depicts a grinder member 6. The grinder member 6 will have disposed therein a blade member/cutter head (not shown) that is rotatably mounted. The grinder member 6 includes a funnel shape throat 46 that directs the particles to the blades, with the blades being used to grind and crush particles such as debris, food and other biodegradable substances. As noted earlier, in the marine industry, food may be disposed of at sea; however, regulations have been promulgated as to the size of the particles. Thus, as the blade member rotates, food particles placed therein may be grinded and crushed by the rotating blade.

The hydraulic valve member 44 will have extending therefrom a first bypass line 48 and a second bypass line 50. The lines 48, 50 will be operatively connected to a hydraulic motor 52. The hydraulic motor is commercially available as will be set forth later. Essentially, the operator may manually direct the hydraulic fluid into the bypass line 48 via the lever. This line will be fed into the hydraulic motor so as to turn the blade member in a clockwise fashion. After the desired amount of rotation, the operator may position the valve member 44 in the neutral position so that the blade member no longer turns.

The operator may wish to rotate the blade member in a counterclockwise fashion. This may be accomplished by shifting the lever of the hydraulic valve member 44 so that the hydraulic fluid is directed to the input/output line 50 which in turn supplies the hydraulic motor 52 with an energy source. With the hydraulic fluid directed to the bypass line 50, the hydraulic motor 52 will cause the blades to rotate in the counterclockwise fashion. In the event that particles become lodged, the counterclockwise rotation will aid in freeing the particles and cleaning the blades. The particles that have been ground can then be exited via the discharge line. It should be noted that during operation, water may be added to the grinder member 6 to aid in grinding.

The hydraulic valve member 44 will have an output line 54 that directs the hydraulic fluid to the third hydraulic valve member 56, with the third hydraulic valve member 56 being similar in design to the first hydraulic valve member 18 and the second hydraulic valve member 44. Thus, leading from the third hydraulic valve member 56 will be the first bypass line 58 as well as the second bypass line 60.

The third hydraulic valve member 56 will be operatively associated with a second compactor 8. In the preferred embodiment, the second compactor 8 will be able to compact garbage that contains environmentally sensitive substances such as oil filters. The second compactor 8 includes a cylindrical member 62 that has operatively disposed therein a rod piston member 64, with the piston member 64 having the piston head 68 disposed thereon. The piston member 64 also has disposed at one end the ram plate 66.

The piston head 68 disposed within the cylinder 62 will form a first cell 70 and a second cell 72, with the first cell being in communication with the first input line 58 and the second cell 72 being in fluid communication with the second input line 60. Thus, as the operator shifts the lever of the hydraulic valve member 56 to allow hydraulic fluid to the input line 58, the hydraulic fluid will fill the first cell 70 which in turn will force the piston member 64 downward. As is well understood, the ram plate 66 will compactor any refuse contained within the receptacle 74. After compaction, the lever of the valve member 56 is placed in the reverse position i.e. directing the hydraulic fluid to input line 60 so that hydraulic fluid enters the second cell 72. As the hydraulic fluid enters the second cell 72, the piston member 64 is lifted within the cylinder 62.

The third hydraulic valve member 56 will have extending therefrom the output line 76. The output line 76 will lead to the hydraulic tank 10, with the hydraulic tank 10 being connected to the pump means 12 inlet. Therefore, the system 2 provides for a complete circuit of hydraulic fluid to each component.

Figure 2:
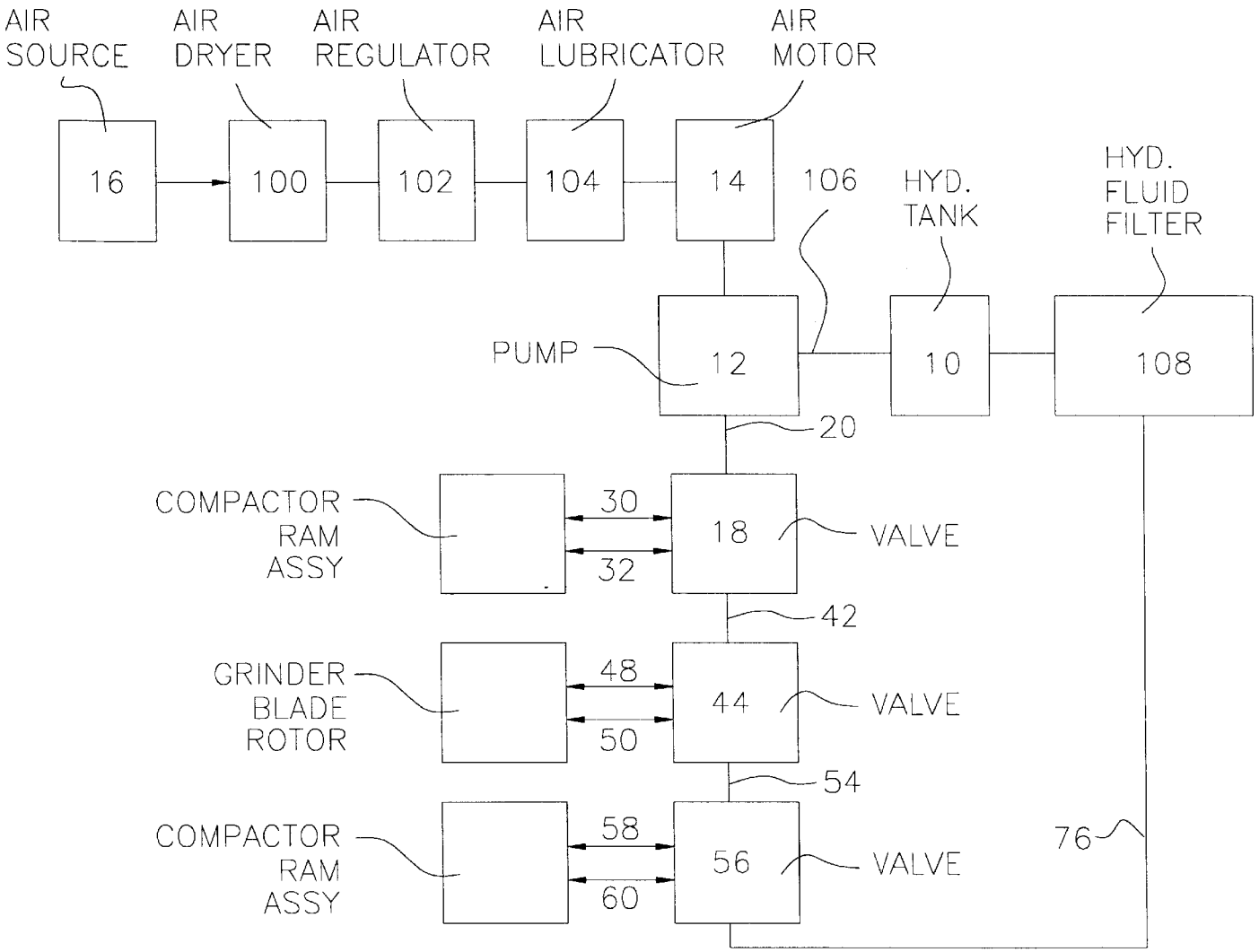
FIG. 2 is a flow chart depicting the power source series arrangement of the present invention.

Referring now to FIG. 2, a flow chart depicting the power source series arrangement of the present invention will now be described. The air source 16 used to energize the air supply member/motor 14 may be provided by means of an air compressor or other means. It should also be noted that other types of energy means for supplying energy to the hydraulic pump are available such as electrical means. In the preferred embodiment, a pneumatic system is utilized.

As shown in FIG. 2, the air supply will be fed into an air dryer means 100 for drying the air. The air dryer means 100 is commercially available from Norgen Inc. and/or Huber Hydraulics under the term air dryer. The air supply will then be directed to an air regulator 102 for regulating the pressure of the air supply to the system. The air regulator 102 is commercially available from Norgen Inc. and/or Huber Hydraulics under the term air regulator. The air supply is then conducted to an air lubricator 104 for lubricating the air supply. The air lubricator is commercially available.

Next, the air is directed to the air motor 14. As previously noted, the air motor 14 will provide for energizing the hydraulic pump 12. The hydraulic pump 12 has an input line 106 and an output line 20. The output line 20 from the pump 12 will convey a pressurized hydraulic fluid to the series circuit arrangement of the system 2. More particularly, the pressurized hydraulic fluid will be directed to the first hydraulic valve member 18. The valve 18 will control the operation of the first compactor 4 as previously described. The bypass line 30 will allow fluid into the cell 26, while the bypass line 32 will allow the hydraulic fluid into the cell 28.

The first hydraulic valve member 18 will have the output line 42 leading therefrom which is operatively connected to the second hydraulic valve member 44. The valve member 44 has the bypass line 48 directed to the hydraulic motor 52 as previously described. By the operator directing the fluid into the bypass line 48, the pressurized hydraulic fluid will cause the hydraulic motor 52 to turn in the clockwise fashion which in turn directs the blades clockwise. When the operator directs the hydraulic fluid to the bypass line 32, the hydraulic motor will rotate in the counterclockwise mode so that the blades rotate counterclockwise.

The valve 44 will have the output line 54 leading therefrom, with the line 54 directed to the third hydraulic valve member 56 of the second compactor 8. The hydraulic valve member 56 will have the first bypass line 58 directed to the first cell 70, while the second bypass line 60 is directed to the second cell 72 for movement of the rod piston 64. The output line 76 leads from the third hydraulic valve member 56 to the hydraulic reservoir tank 10. As noted earlier, the input line 106 directs the hydraulic fluid from tank 10 to the input of the hydraulic pump 12. In the preferred embodiment, a hydraulic fluid filter 108 is included so that the fluid being pumped through the system 2 can be filtered from impurities.

Figure 3:
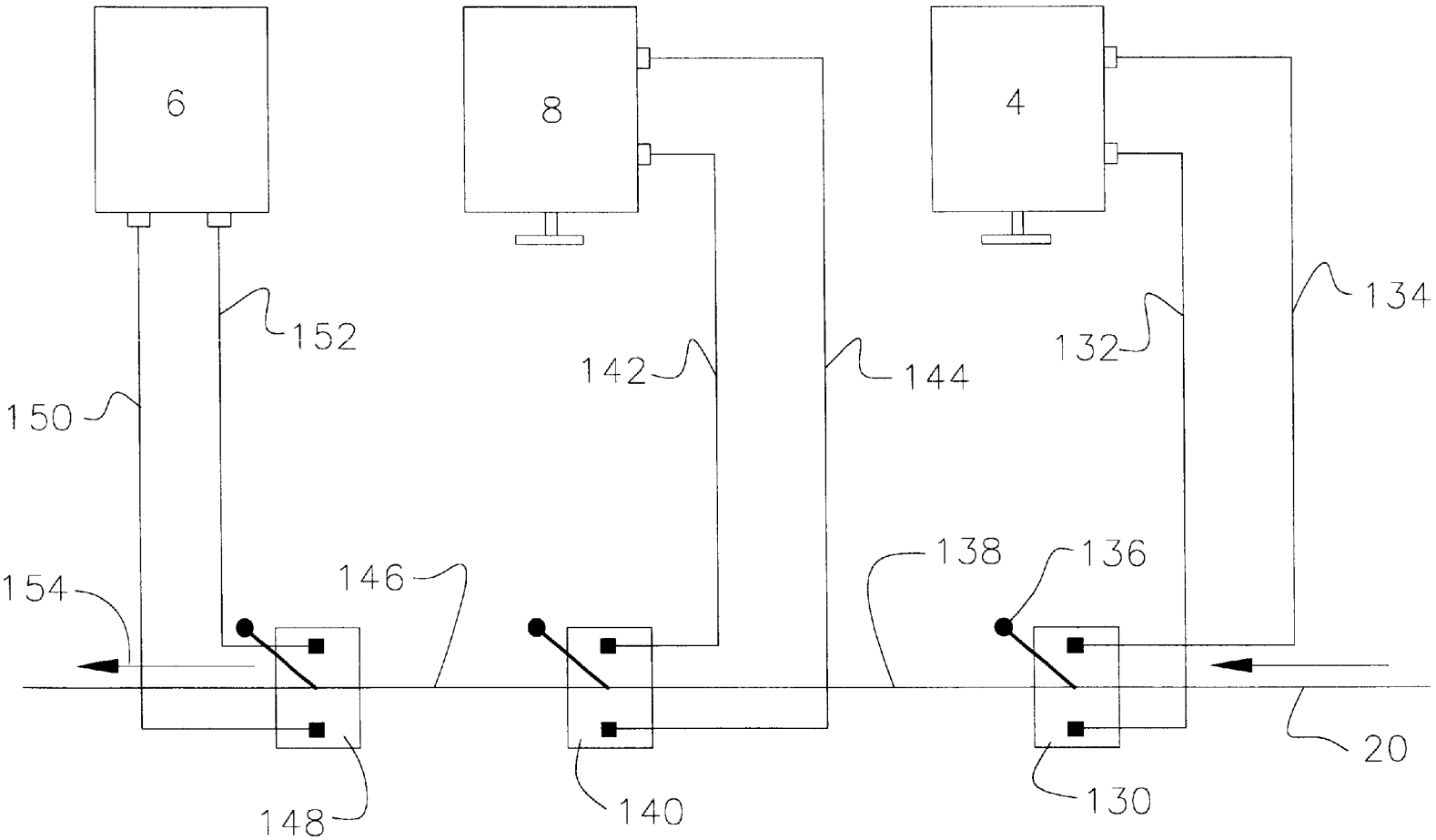
FIG. 3 is a flow chart schematic depicting the series arrangement for providing hydraulic power to the components of the present invention.

Referring now to FIG. 3, a flow chart schematic depicting the series arrangement for providing hydraulic power to the components of the present invention in a second embodiment will now be described. It should be noted that it is possible, with the teachings of the present invention, to allow substitution of one of the components in place of another. Therefore, the series arrangement may be set up so that the arrangement is from the first compactor 4, to the food grinder 6, to the second compactor 8. Alternatively, the operator may arrange the series circuit so that the flow is from the first compactor 4, to the second compactor 8, to the food grinder 6 (which is the series circuit arrangement of FIG. 3).

Therefore, the series arrangement of FIG. 3 includes having the output 20 from the pump 12 feed into the hydraulic valve member 130 (which is a similar type as those described earlier with reference to FIGS. 1 and 2). The hydraulic valve member 130 will have the bypass line 132 directed to the compactor 4, and in particular, to the first cell 26. The hydraulic valve member 130 will also have the bypass line 134 that is directed to the second cell 28. As shown, the operator may direct the hydraulic fluid to either bypass line 132 or 134 by control of the lever 136.

The output line 138 will in turn be directed to the hydraulic fluid valve 140. The hydraulic fluid valve 140 will have a first bypass line 142 that is directed to the first cell 70 of second compactor 8. The valve 140 will also contain the second bypass line 144 that is operatively associated with the second cell 72 of the second compactor 8 as previously described. The valve 140 also contains the lever for manual operation of the bypass lines.

As shown in FIG. 3, valve 140 will have the output line 146 leading therefrom that in turn will lead to the hydraulic valve member 148. The valve 148 will have the first bypass line 150 directed to the food grinder 6, and more particularly, will be directed to the hydraulic motor 52 for imparting a clockwise rotation. The valve 148 will also contain the bypass line 152, with the bypass line being operatively associated with the food grinder's hydraulic motor 52 so as to cause the grinder blades to rotate in a counterclockwise mode.

The hydraulic valve member 148 will have the output line 154 that leads therefrom, with the output line 154 leading to the hydraulic reservoir tank 10, all as previously described. The series arrangement herein described may be utilized so that the hydraulic tank 10 is connected with the pump means 12 as was described with reference to FIGS. 1 and 2.

Figure 4A:
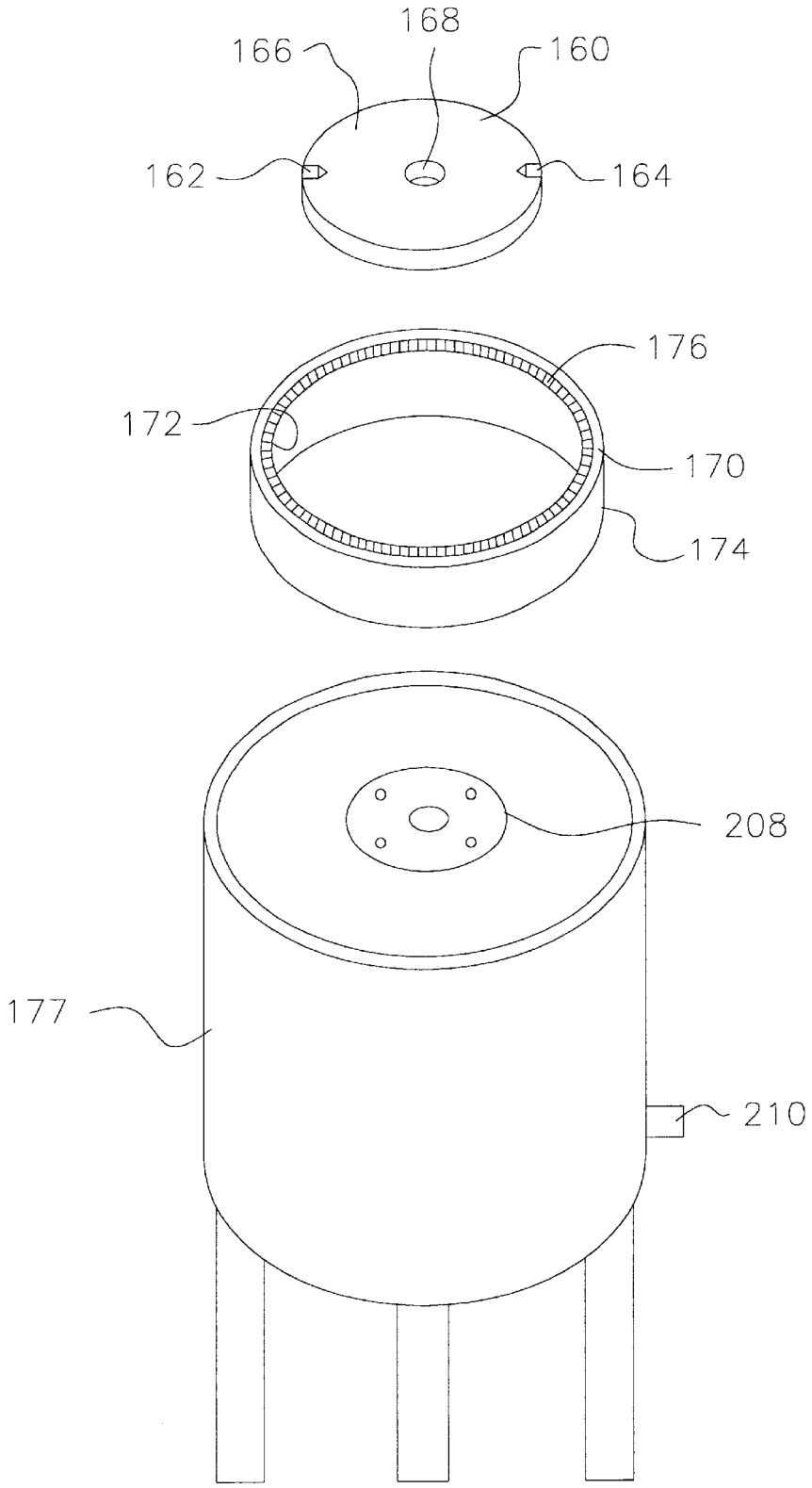
FIG. 4A is a disassembled illustration of the grinder member used with the present invention.

Referring now to FIG. 4A, the preferred embodiment of the grinder member 6 will now be disclosed. FIG. 4A is a disassembled view of the grinder member, with the grinder member 6 generally comprising a cutter head plate 160 which is generally a circular plate having a first lug 162 and a second lug 164 attached to the first plate face 166. The cutter head plate 160 also contains the center opening 168. The grinder member 6 includes the cutter ring 170, with the cutter ring 170 being cylindrical. The cutter ring will have an inner diameter 172 and an outer diameter 174. The inner diameter 172 has a series of notches or teeth 176 that are formed on the inner diameter 172. The cutting head plate 160 is disposed within said cutter ring 170 such that the series of notches 176 cooperate with the lugs 162/164 so that a limited clearance is in place between the notches 176 and the cutter ring. In operation, as the plate 160 is rotated, the lugs 162/164 will grind any particles that fall within this clearance via the notches 176. The ring and plate are positioned within the generally cylindrical container 177. A typical grinder member is commercially available from Red Goat Dispensers, under the name Model No. A-R7.

Figure 4B:
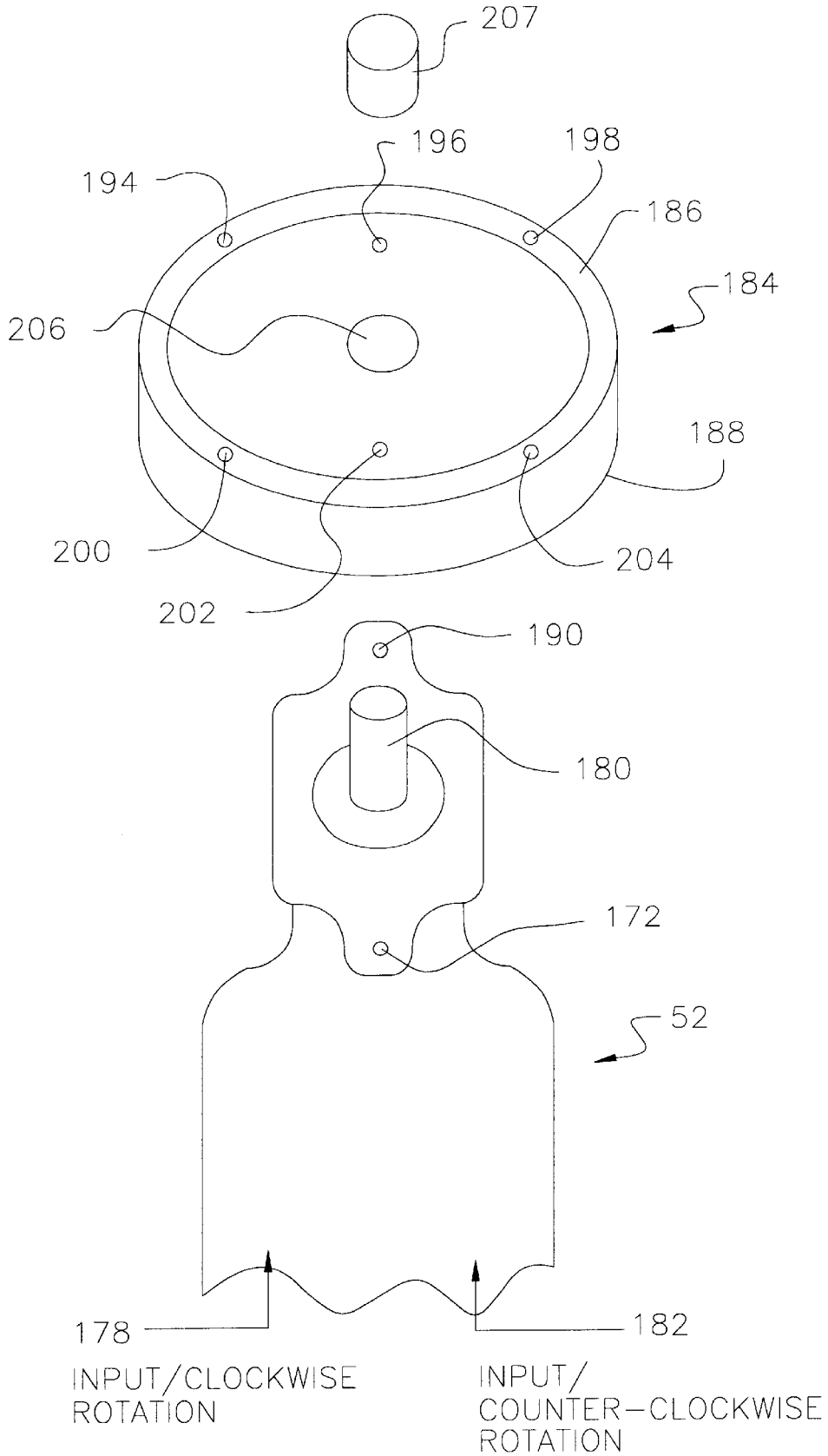
FIG. 4B is a disassembled illustration of the hydraulic motor and adapter plate of the present invention.

However, the commercially available grinders are equipped with an electric motor, which is not suitable for purposes of this invention. Therefore, applicant has modified the grinder member 6 according to FIG. 4B. The FIG. 4B is a disassembled view of the hydraulic motor 52 and adaptor plate. The hydraulic motor 52 will have a first input 178 that will allow the shaft 180 to rotate in a clockwise fashion, while the second input 182 will cause the shaft 180 to rotate in a counter-clockwise mode. The first input 178 will connect to the line 48 while the input 182 will connect to the line 50. Also included is the adaptor plate 184. The adaptor plate 184 has a first face 186 and a second face 188. The second face 188 will cooperate and mate with the motor 52, and in particular, will be adapted to the holes 190 and 192. As depicted in FIG. 4B, the adaptor plate 184 contains the openings 194, 196, 198, 200, 202, 204. The opening 196 will align with opening 190, and the opening 192 will align with the opening 202. Proper securing means, such as a nut and bolt, will be added (not shown).

The center opening 206 will have the shaft 180 fitted therethrough. A sleeve 207 is fitted about the shaft 180 in order to properly size the sleeve 207 as between the shaft 180 and opening 206. The adaptor plate 184 will then make-up to the inside plate 208, with the inside plate 208 being inside the grinder cylindrical container as shown in FIG. 4A. The openings 194, 198, 200, and 204 will cooperate with the openings contained on the inside plate 206. The cooperation of the plates 184 and 208 provide for a proper seal so that the grinded particles and/or added water do not leak therethrough causing harm to the hydraulic motor 52. The grinder member 6 will also have a throat 46(shown in FIG. 1) that is placed on top of the cylindrical container 177 so that the particles that are ground will not fly out but instead be contained within the cylindrical container 177. Once the particles are grinded, the ground particles may then be funneled outward via the discharge line 210.

Changes and modifications in the specifically described embodiments can be carried out without departing from the scope of the invention which is intended to be limited only by the scope of the appended claims.

I claim:

1. A refuse and grinding system comprising:

a hydraulic fluid supply means for supplying a hydraulic fluid;

a first compactor adapted for containing a refuse, said first compactor having a first ram assembly and a first hydraulic valve member, said first ram assembly having a first cell and a second cell, said first hydraulic valve member being operatively connected with said hydraulic fluid supply means;

a second compactor adapted for containing a hydrocarbon refuse, said second compactor having a second ram assembly and a second hydraulic valve member, said second ram assembly having a third cell and a fourth cell, said second hydraulic valve member bing operatively connected to said first hydraulic valve member;

a pump means, containing an inlet fluidly connected to said hydraulic fluid supply and an outlet operatively associated with said first hydraulic valve member, for pumping said hydraulic supply to said first hydraulic valve member;

an air supply member connected to said pump member so as to energize said pump means;

a grinder member having a blade member contained thereon, said blade member being operatively connected to a hydraulic motor means for supplying power to said blade member, said hydraulic motor means having a hydraulic supply inlet being in fluid communication with said second hydraulic valve member.

2. The refuse and grinding system of claim 1 wherein said first ram assembly contains a first cylindrical member with a first piston disposed therein forming the first cell and the second cell, said first cell containing a first channel fluidly connecting said first cell with said first hydraulic valve member and said second cell containing a second channel fluidly connecting said second cell with said first hydraulic valve member.

3. The refuse and grinding system of claim 2 wherein said second ram assembly contains a second cylindrical member with a second piston disposed therein forming the third cell and the fourth cell, said third cell containing a third channel fluidly connecting said third cell with said second hydraulic valve member and said fourth cell containing a fourth channel fluidly connecting said fourth cell with said second hydraulic valve member.

4. The refuse and grinding system of claim 3 wherein said hydraulic supply inlet of said grinder member contains a third hydraulic valve member, said third hydraulic valve member being operatively connected to said hydraulic motor means, said third hydraulic valve member having a first position directed to rotate said hydraulic motor means in a clockwise mode and a second position directed to rotate said hydraulic motor means in a counterclockwise mode.

5. The refuse and grinding system of claim 4 further comprising:

an air lubricator means, operatively associated with said air supply member, for lubricating the air supply to said pump means;

an air filter means, operatively associated with said air supply member, for filtering the air supply being directed into said pump means.

6. The refuse and grinding system of claim 5 wherein said pump means comprises:

an air over hydraulics motor, said air over hydraulics motor adapted to receive said air supply and produce a torque;

a hydraulic pump member operatively connected to said air over hydraulics motor and adapted to receive said torque from said shaft for driving said hydraulic pump member.

7. The refuse and grinding system of claim 6 wherein said first compactor includes a first receptacle for receiving refuse, and wherein said receptacle is movably mounted within said first compactor.

8. The refuse and grinding system of claim 7 wherein said second compactor includes a second receptacle for receiving a hydrocarbon contaminated refuse.

9. A refuse and grinding system comprising:

a hydraulic fluid supply for supplying a hydraulic fluid;

a first compactor adapted for containing a refuse, said first compactor having a first ram assembly and a first hydraulic valve member, said first hydraulic valve member being operatively connected with said hydraulic fluid supply;

a second compactor adapted for containing a hydrocarbon refuse, said second compactor having a second ram assembly and a second hydraulic valve member, said second hydraulic valve member being operatively connected to said first hydraulic valve member;

a grinder means for grinding refuse, said grinder means being operatively connected to said hydraulic fluid supply, said grinder means having a hydraulic supply inlet being in fluid communication with said first hydraulic valve member.

10. The refuse and grinding system of claim 9 further comprising:

energizing means for energizing said first compactor, said second compactor and said grinder means with said hydraulic fluid.

11. The refuse and grinding system of claim 10 wherein said energizing means comprises:

a pump means, operatively associated with said first hydraulic valve member, for pumping said hydraulic supply to said first hydraulic valve member;

an air supply member adapted for providing an air supply to said pump means.

12. The refuse and grinding system of claim 11 wherein said first ram assembly contains a first cylindrical member with a first piston disposed therein forming a first cell and a second cell, said first cell containing a first channel fluidly connecting said first cell with said first hydraulic valve member and said second cell containing a second channel fluidly connecting said second cell with said first hydraulic valve member.

13. The refuse and grinding system of claim 12 wherein said second ram assembly contains a second cylindrical member with a second piston disposed therein forming a third cell and a fourth cell, said third cell containing a third channel fluidly connecting said third cell with said second hydraulic valve member and said fourth cell containing a fourth channel fluidly connecting said fourth cell with said second hydraulic valve member.

14. The refuse and grinding system of claim 13 wherein said hydraulic supply inlet of said grinder member contains a third hydraulic valve member, said third hydraulic valve member being operatively connected to said grinder means, said third hydraulic valve member having a first position directed to rotate said grinder means in a clockwise mode and a second position directed to rotate said grinder means in a counterclockwise mode.

15. The refuse and grinding system of claim 14 wherein said grinder means comprises:

a cutter container having an inner portion and an outer portion;

a cutter head plate contained within said inner portion of said cutter container;

a cutter ring having an opening therein so that said cutter head plate is disposed therein, said cutter head plate and said cutter ring adapted to form a clearance for placement of a portion of the refuse;

a hydraulic motor having a shaft extending therefrom, said shaft being connected to said cutter head plate to impart a rotation to said cutter head plate;

an adapter plate mounted on said hydraulic motor, said adapter plate containing an aperture that has said shaft being disposed therethrough.

16. The refuse and grinding system of claim 15 wherein said pump means comprises:

an air over hydraulics motor adapted to receive said air supply and provide a torque;

a hydraulic pump member operatively connected to said air over hydraulic motor and adapted to receive said torque for driving said hydraulic pump member.

17. The refuse and grinding system of claim 16 wherein said first compactor comprises a first receptacle for receiving refuse, and wherein said first receptacle is movably mounted within said first compactor.

18. The refuse and grinding system of claim 17 wherein said second compactor comprises a second receptacle for receiving a hydrocarbon contaminated refuse.

* * * * *